US008740658B2

(12) United States Patent
Kuriyagawa

(10) Patent No.: US 8,740,658 B2
(45) Date of Patent: Jun. 3, 2014

(54) OUTBOARD MOTOR CONTROL APPARATUS

(75) Inventor: Koji Kuriyagawa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 238 days.

(21) Appl. No.: 13/115,298

(22) Filed: May 25, 2011

(65) Prior Publication Data

US 2011/0294374 A1 Dec. 1, 2011

(30) Foreign Application Priority Data

May 28, 2010 (JP) ..... 2010-123290

(51) Int. Cl.
*B63H 21/22* (2006.01)
*B63H 23/00* (2006.01)

(52) U.S. Cl.
USPC ..... 440/1

(58) Field of Classification Search
USPC ..... 440/1, 49, 75, 80, 81, 84, 86, 87
See application file for complete search history.

(56) References Cited

U.S. PATENT DOCUMENTS

| | | | | |
|---|---|---|---|---|
| 5,142,473 | A * | 8/1992 | Davis | 701/21 |
| 6,755,163 | B2 | 6/2004 | Katayama et al. | |
| 7,238,071 | B2 * | 7/2007 | Takada et al. | 440/84 |
| 7,243,009 | B2 * | 7/2007 | Kaji | 701/21 |
| 7,354,321 | B2 * | 4/2008 | Takada et al. | 440/1 |
| 7,558,664 | B2 | 7/2009 | Banba et al. | |
| 7,762,858 | B2 | 7/2010 | Suzuki et al. | |
| 7,909,670 | B2 | 3/2011 | Suzuki et al. | |

FOREIGN PATENT DOCUMENTS

| | | | |
|---|---|---|---|
| JP | 05-149420 | A | 6/1993 |
| JP | 11-201189 | A | 7/1999 |
| JP | 2003-003898 | A | 1/2003 |
| JP | 2008-157043 | A | 7/2008 |
| JP | 2009-190672 | A | 8/2009 |
| JP | 2009-196516 | A | 9/2009 |

OTHER PUBLICATIONS

JP Office Action with English translation thereof issued in corresponding Japanese patent application onSep. 11, 2013.

* cited by examiner

*Primary Examiner* — Daniel V Venne
(74) *Attorney, Agent, or Firm* — Carrier Blackman & Associates, P.C.; Joseph P. Carrier; Anne G. Sabourin

(57) ABSTRACT

In an apparatus for controlling operation of an outboard motor having an internal combustion engine and transmission, it is configured to control operation of the transmission to change the gear position to the first or second speed in response to a speed change command outputted upon an operator's manipulation, determine whether a throttle valve of the engine is at a fully-opened position or thereabout when the speed change command to the first speed is outputted, and determine whether the engine is under a predetermined operating condition when the throttle valve is determined to be at the fully-opened position or thereabout, wherein the transmission controller changes the gear position from the first speed to the second speed when the engine is determined to be under the predetermined operating condition. With this, it becomes possible to mitigate load on a transmission gear to improve durability of the transmission.

13 Claims, 12 Drawing Sheets

OUTBOARD MOTOR CONTROL APPARATUS

BACKGROUND OF THE INVENTION

1. Technical Field

This invention relates to an outboard motor control apparatus, particularly to an apparatus for controlling an outboard motor with a transmission.

2. Background Art

In recent years, there is proposed a technique for an outboard motor having a transmission interposed at a power transmission shaft between an internal combustion engine and a propeller to change an output of the engine in speed and transmit it to the propeller, as taught, for example, by Japanese Laid-Open Patent Application No. 2009-190672. In the reference, a gear position (ratio) of the transmission is changed to the first or second speed in response to a speed change command inputted by the operator.

SUMMARY OF INVENTION

However, since a technique in the reference is configured as above, the engine is operated at relatively high speed when the speed change command to the first speed is outputted upon manipulation by the operator and if this condition continues for a long time, a transmission gear becomes overloaded and it may degrade durability of the transmission disadvantageously.

An object of this invention is therefore to overcome the foregoing problem by providing an apparatus for controlling an outboard motor having a transmission, which apparatus can prevent the engine from being operated at high speed continuously for a long time when a speed change command to the first speed is outputted, thereby mitigating the load on a transmission gear to improve durability of the transmission.

In order to achieve the object, this invention provides in the first aspect an apparatus for controlling operation of an outboard motor adapted to be mounted on a stern of a boat and having an internal combustion engine to power a propeller through a drive shaft and a propeller shaft, and a transmission that is installed at a location between the drive shaft and the propeller shaft, the transmission being selectively changeable in gear position to establish speeds including at least a first speed and a second speed and transmitting power of the engine to the propeller with a gear ratio determined by established speed, comprising: a speed change command outputter adapted to output a speed change command upon manipulation by an operator; a transmission controller adapted to control operation of the transmission to change the gear position to the first speed or the second speed in response to the outputted speed change command; a full throttle opening determiner adapted to determine whether a throttle valve of the engine is at a fully-opened position or thereabout when the speed change command to the first speed is outputted; and an operating condition determiner adapted to determine whether the engine is under a predetermined operating condition when the throttle valve is determined to be at the fully-opened position or thereabout, and the transmission controller changes the gear position from the first speed to the second speed when the engine is determined to be under the predetermined operating condition.

In order to achieve the object, this invention provides in the second aspect a method for controlling operation of an outboard motor adapted to be mounted on a stern of a boat and having an internal combustion engine to power a propeller through a drive shaft and a propeller shaft, and a transmission that is installed at a location between the drive shaft and the propeller shaft, the transmission being selectively changeable in gear position to establish speeds including at least a first speed and a second speed and transmitting power of the engine to the propeller with a gear ratio determined by established speed, comprising the steps of: outputting a speed change command upon manipulation by an operator; controlling operation of the transmission to change the gear position to the first speed or the second speed in response to the outputted speed change command; determining whether a throttle valve of the engine is at a fully-opened position or thereabout when the speed change command to the first speed is outputted; and determining whether the engine is under a predetermined operating condition when the throttle valve is determined to be at the fully-opened position or thereabout, and the step of controlling changes the gear position from the first speed to the second speed when the engine is determined to be under the predetermined operating condition.

BRIEF DESCRIPTION OF DRAWINGS

The above and other objects and advantages of the invention will be more apparent from the following description and drawings in which.

DESCRIPTION OF EMBODIMENTS

Embodiments of an outboard motor control apparatus according to the invention will now be explained with reference to the attached drawings.

Figure 1:
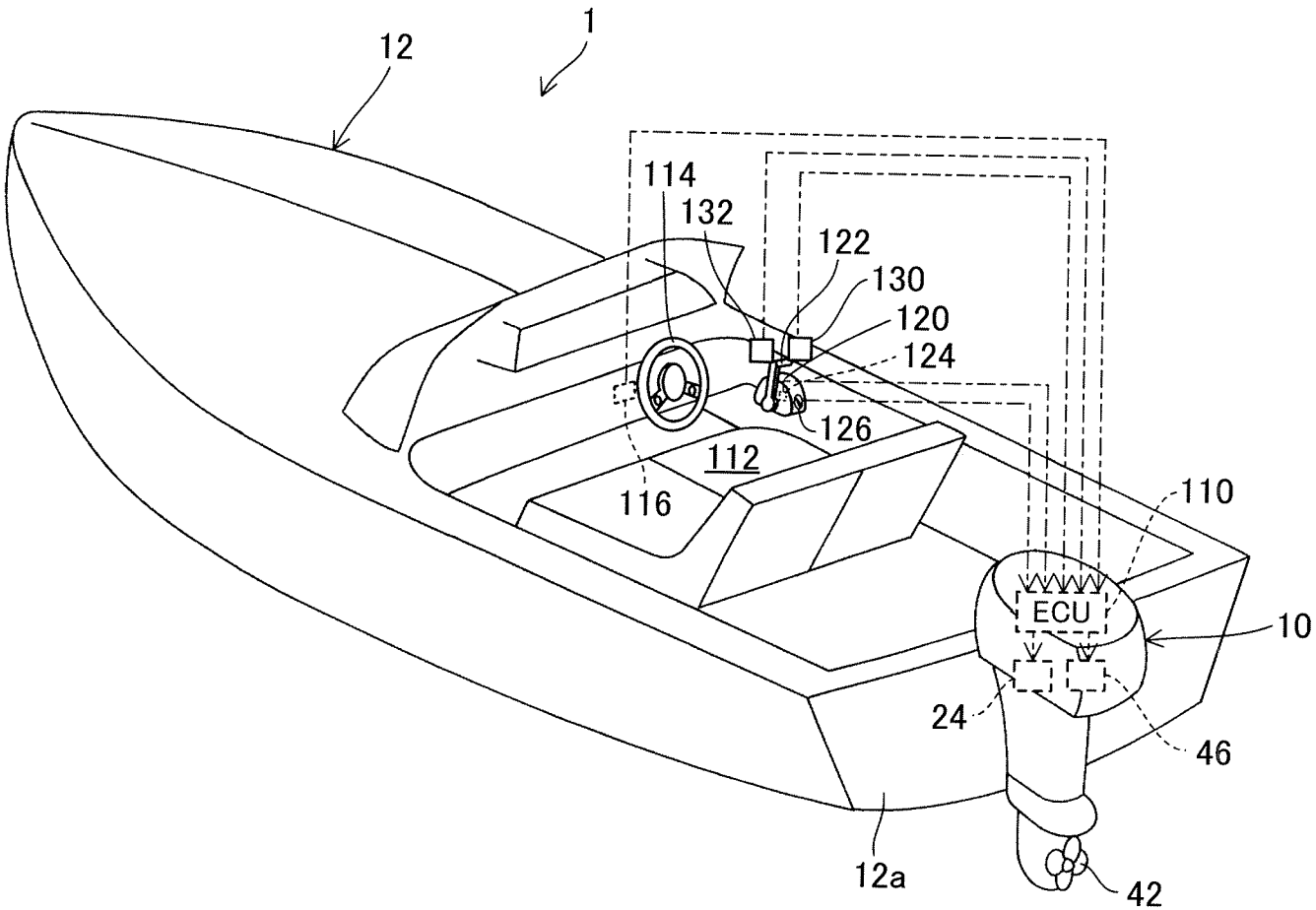
FIG. 1 is an overall schematic view of an outboard motor control apparatus including a boat according to a first embodiment of the invention.
Figure 2:
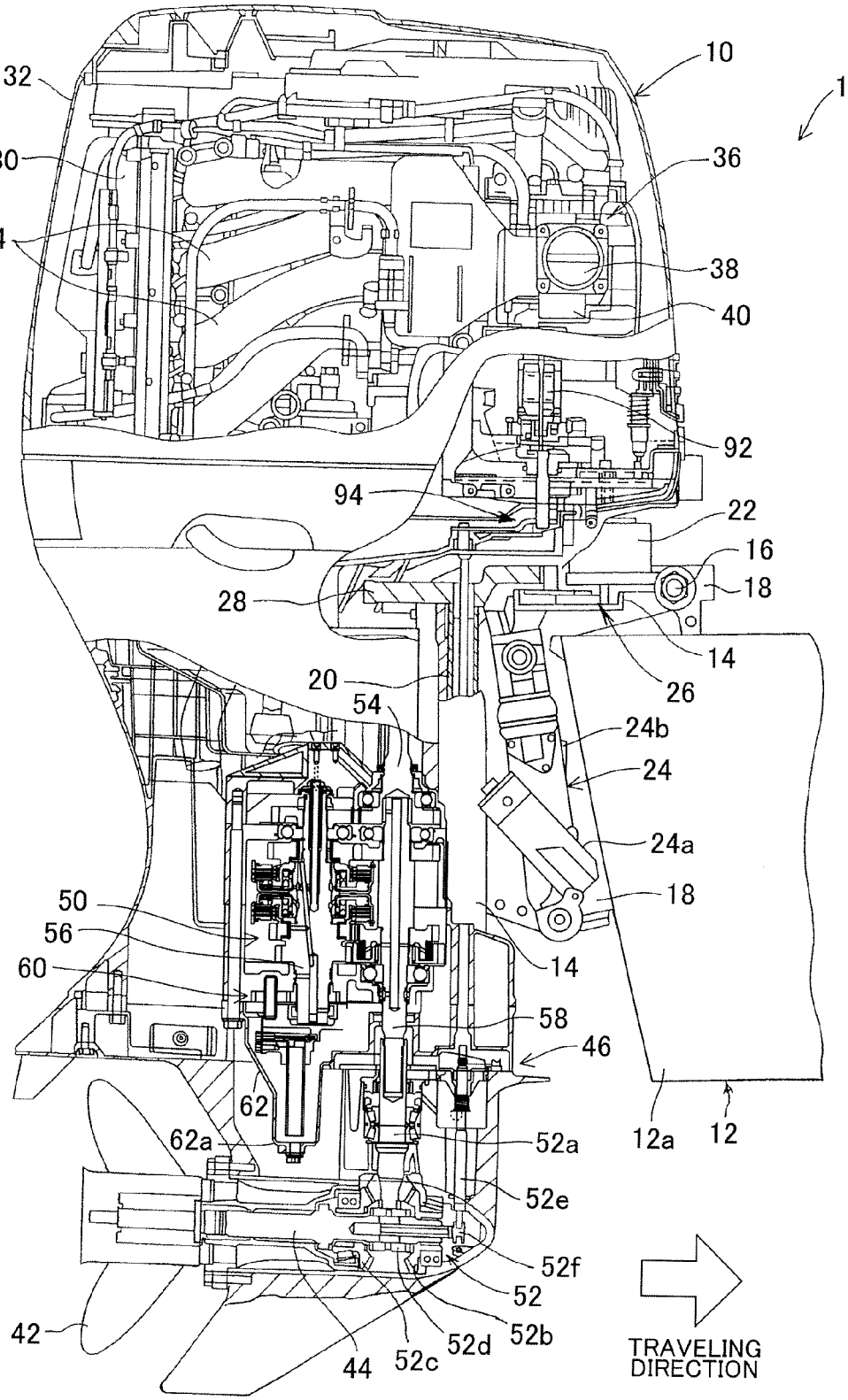
FIG. 2 is an enlarged sectional side view partially showing the outboard motor shown in FIG. 1.

FIG. 1 is an overall schematic view of an outboard motor control apparatus including a boat according to an embodiment of the invention. FIG. 2 is an enlarged sectional side view partially showing the outboard motor shown in FIG. 1 and FIG. 3 is an enlarged side view of the outboard motor.

Figure 3:
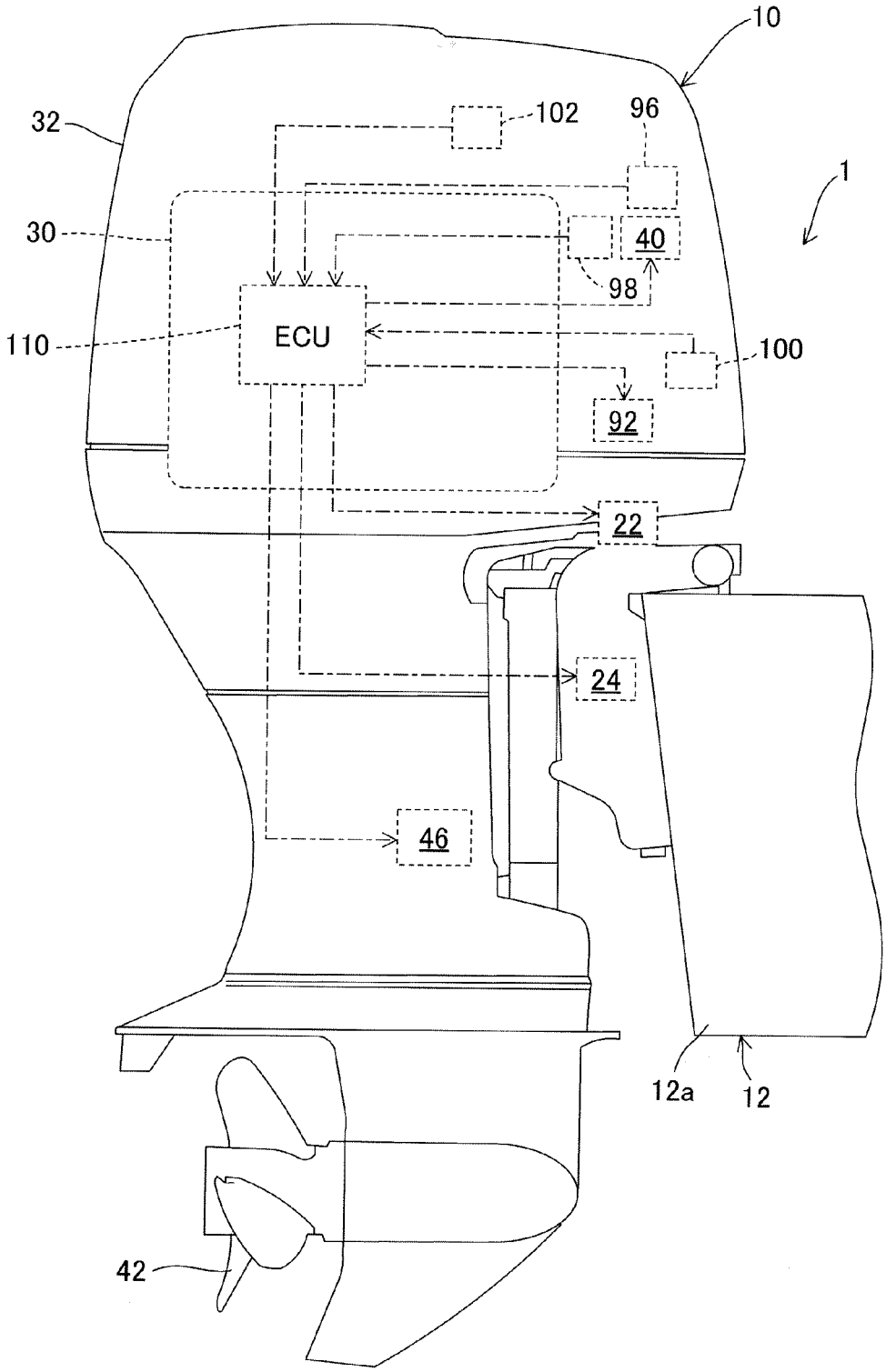
FIG. 3 is an enlarged side view of the outboard motor shown in FIG. 1.

In FIGS. 1 to 3, a symbol 1 indicates a boat or vessel whose hull 12 is mounted with the outboard motor 10. As clearly shown in FIG. 2, the outboard motor 10 is clamped (fastened) to the stern or transom 12*a* of the boat 1, more precisely, to the stern 12*a* of the hull 12 through a swivel case 14, tilting shaft 16 and stern brackets 18.

An electric steering motor (actuator) 22 for operating a shaft 20 which is housed in the swivel case 14 to be rotatable about the vertical axis and a power tilt-trim unit (actuator; hereinafter called the "trim unit") 24 for regulating a tilt angle and trim angle of the outboard motor 10 relative to the boat 1 (i.e., hull 12) by tilting up/down and trimming up/down are installed near the swivel case 14. A rotational output of the steering motor 22 is transmitted to the shaft 20 via a speed reduction gear mechanism 26 and mount frame 28, whereby the outboard motor 10 is steered about the shaft 20 as a steering axis to the right and left directions (steered about the vertical axis).

The trim unit 24 integrally comprises a hydraulic cylinder 24*a* for adjusting the tilt angle and a hydraulic cylinder 24*b* for adjusting the trim angle. In the trim unit 24, the hydraulic cylinders 24*a*, 24*b* are extended/contracted so that the swivel case 14 is rotated about the tilting shaft 16 as a rotational axis, thereby tiling up/down and trimming up/down the outboard motor 10. The hydraulic cylinders 24*a*, 24*b* are connected to a hydraulic circuit (not shown) in the outboard motor 10 and extended/contracted upon being supplied with operating oil therethrough.

An internal combustion engine (hereinafter referred to as the "engine") 30 is disposed in the upper portion of the outboard motor 10. The engine 30 comprises a spark-ignition, water-cooling gasoline engine with a displacement of 2,200 cc. The engine 30 is located above the water surface and covered by an engine cover 32.

An air intake pipe 34 of the engine 30 is connected to a throttle body 36. The throttle body 36 has a throttle valve 38 installed therein and an electric throttle motor (actuator) 40 for opening and closing the throttle valve 38 is integrally disposed thereto.

The output shaft of the throttle motor 40 is connected to the throttle valve 38 via a speed reduction gear mechanism (not shown). The throttle motor 40 is operated to open and close the throttle valve 38, thereby regulating the flow rate of the air sucked in the engine 30 to control a speed of the engine 30 (engine speed).

The outboard motor 10 further comprises a propeller shaft (power transmission shaft) 44 that is supported to be rotatable about the horizontal axis and attached with a propeller 42 at its one end to transmit power output of the engine 30 thereto, and a transmission 46 that is interposed at a location between the engine 30 and propeller shaft 44 and has a plurality of gear positions, i.e., first, second and third speeds.

The transmission 46 comprises a transmission mechanism 50 that is selectively changeable in gear positions and a shift mechanism 52 that can change a shift position among forward, reverse and neutral positions.

Figure 4:
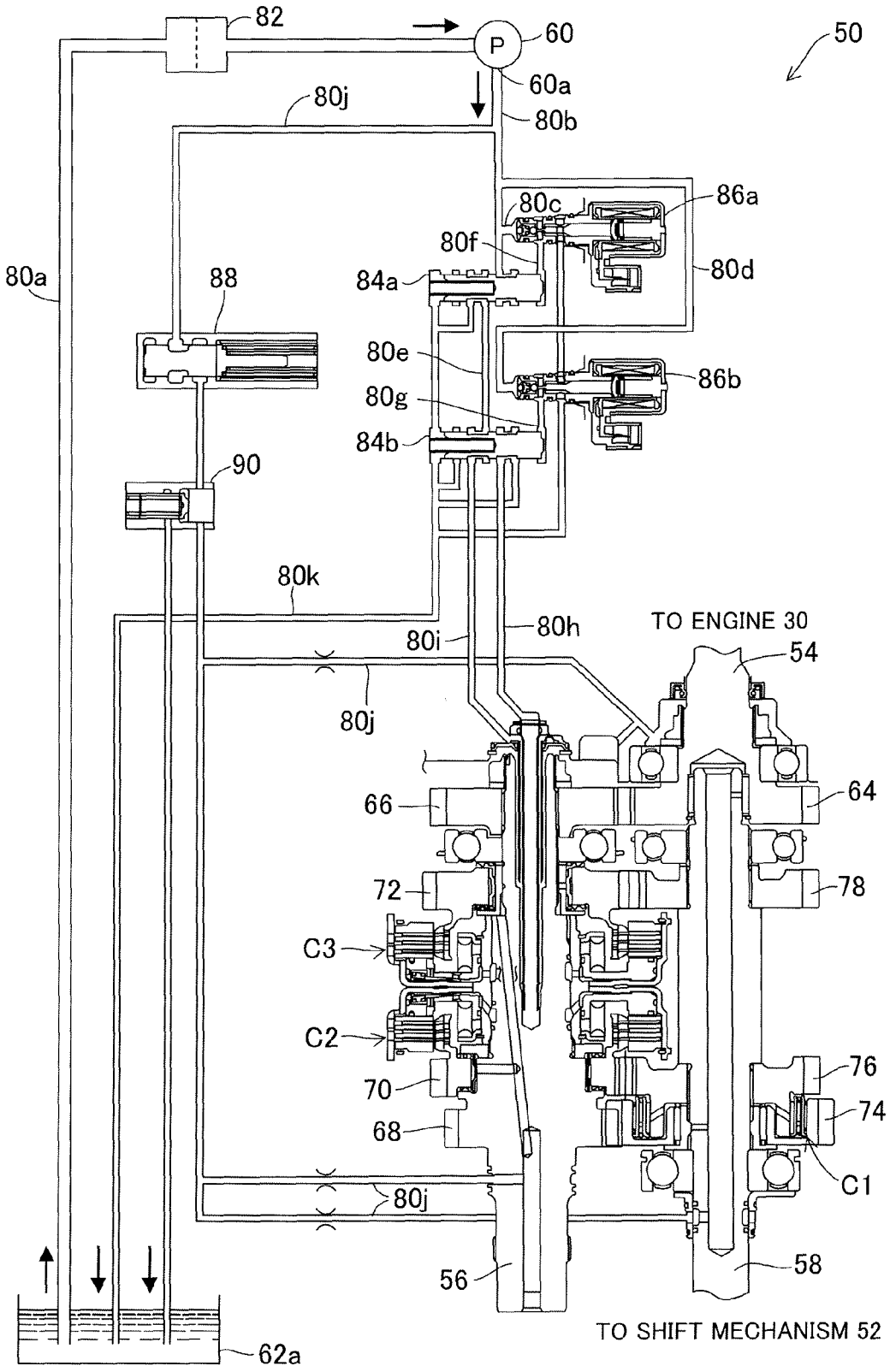
FIG. 4 is a hydraulic circuit diagram schematically showing a hydraulic circuit of a transmission mechanism shown in FIG. 2.

FIG. 4 is a hydraulic circuit diagram schematically showing a hydraulic circuit of the transmission mechanism 50.

As shown in FIGS. 2 and 4, the transmission mechanism 50 comprises a parallel-axis type transmission mechanism with distinct gear positions (ratios), which includes an input shaft (drive shaft) 54 connected to the crankshaft (not shown in the figures) of the engine 30, a countershaft 56 connected to the input shaft 54 through a transmission gear, and a first connecting shaft 58 connected to the countershaft 56 through several transmission gears. Those shafts 54, 56, 58 are installed in parallel.

The countershaft 56 is connected with a hydraulic pump (gear pump; shown in FIGS. 2 and 4) 60 that pumps up the operating oil (lubricating oil) and forwards it to transmission clutches and lubricated portions of the transmission mechanism 50 (explained later). The foregoing shafts 54, 56, 58, hydraulic pump 60 and the like are housed in a case 62 (shown only in FIG. 2). An oil pan 62*a* for receiving the operating oil is formed at the bottom of the case 62.

In the so-configured transmission mechanism 50, the gear installed on the shaft to be rotatable relative thereto is fixed on the shaft through the transmission clutch so that the transmission 46 is selectively changeable in the gear position to establish one of the three speeds (i.e., first to third speeds), and the output of the engine 30 is changed with the gear ratio determined by the established (selected) gear position (speed; gear) and transmitted to the propeller 42 through the shift mechanism 52 and propeller shaft 44. A gear ratio of the gear position (speed) is set to be the highest in the first speed and decreases as the speed changes to second and then third speed.

The further explanation on the transmission mechanism 50 will be made. As clearly shown in FIG. 4, the input shaft 54 is supported with an input primary gear 64. The countershaft 56 is supported with a counter primary gear 66 to be meshed with the input primary gear 64, and also supported with a counter first-speed gear 68, counter second-speed gear 70 and counter third-speed gear 72.

The first connecting shaft 58 is supported with an output first-speed gear 74 to be meshed with the counter first-speed gear 68, an output second-speed gear 76 to be meshed with the counter second-speed gear 70, and an output third-speed gear 78 to be meshed with the counter third-speed gear 72.

In the above configuration, when the output first-speed gear 74 supported to be rotatable relative to the first connecting shaft 58 is brought into a connection with the first connecting shaft 58 through a first-speed clutch C1, the first speed (gear position) is established. The first-speed clutch C1 comprises a one-way clutch. When a second-speed or third-speed hydraulic clutch C2 or C3 (explained later) is supplied with hydraulic pressure so that the second or third speed (gear position) is established and the rotational speed of the first connecting shaft 58 becomes greater than that of the output first-speed gear 74, the first-speed clutch C1 makes the output first-speed gear 74 rotate idly (i.e., rotate without being meshed).

When the counter second-speed gear 70 supported to be rotatable relative to the countershaft 56 is brought into a connection with the countershaft 56 through the second-speed hydraulic clutch (transmission clutch) C2, the second speed (gear position) is established. Further, when the counter third-speed gear 72 supported to be rotatable relative to the countershaft 56 is brought into a connection with the countershaft 56 through the third-speed hydraulic clutch (transmission clutch) C3, the third speed (gear position) is established. The hydraulic clutches C2, C3 connect the gears 70, 72 to the countershaft 56 upon being supplied with the hydraulic pressure, while making the gears 70, 72 rotate idly when the hydraulic pressure is not supplied.

Thus the interconnections between the gears and shafts through the clutches C1, C2, C3 are performed by controlling hydraulic pressure supplied from the pump 60 to the hydraulic clutches C2, C3.

The further explanation will be made. When the oil pump 60 is driven by the engine 30, it pumps up the operating oil in the oil pan 62*a* to be drawn through an oil passage 80*a* and strainer 82 and forwards it from a discharge port 60*a* to a first switching valve 84*a* through an oil passage 80*b* and to first and second electromagnetic solenoid valves (linear solenoid valves) 86*a*, 86*b* through oil passages 80*c*, 80*d*.

The first switching valve 84*a* is connected to a second switching valve 84*b* through an oil passage 80*e*. Each of the valves 84*a*, 84*b* has a movable spool installed therein and the spool is urged by a spring at its one end (left end in the drawing) toward the other end. The valves 84*a*, 84*b* are connected on the sides of the other ends of the spools with the first and second solenoid valves 86*a*, 86*b* through oil passages 80*f*, 80*g*, respectively.

Upon being supplied with current (i.e., made ON), a spool housed in the first solenoid valve 86*a* is displaced to output the hydraulic pressure supplied from the pump 60 through the oil passage 80*c* to the other end side of the spool of the first switching valve 84*a*. Accordingly, the spool of the first switching valve 84*a* is displaced to its one end side, thereby forwarding the operating oil in the oil passage 80*b* to the oil passage 80*e*.

Similarly to the first solenoid valve 86*a*, upon being supplied with current (i.e., made ON), a spool of the second solenoid valve 86*b* is displaced to output the hydraulic pressure supplied from the pump 60 through the oil passage 80*d* to the other end side of the spool of the second switching valve 84*b*. Accordingly, the spool of the second switching valve 84*b* is displaced to its one end side, thereby forwarding the operating oil in the oil passage 80*e* to the second-speed hydraulic clutch C2 through the oil passage 80*h*. In contrast, when the second solenoid valve 86*b* is not supplied with current (made OFF) and no hydraulic pressure is outputted to the other end side of the second switching valve 84*b*, the operating oil in the oil passage 80*e* is forwarded to the third-speed hydraulic clutch C3 through the oil passage 80*i*.

When the first and second solenoid valves 86*a*, 86*b* are both made OFF, the hydraulic pressure is not supplied to the hydraulic clutches C2, C3 and hence, the output first-speed gear 74 and first connecting shaft 58 are interconnected through the first-speed clutch C1 so that the first speed is established.

When the first and second solenoid valves 86*a*, 86*b* are both made ON, the hydraulic pressure is supplied to the second-speed hydraulic clutch C2 and accordingly, the counter second-speed gear 70 and countershaft 56 are interconnected so that the second speed is established. Further, when the first solenoid valve 86*a* is made ON and the second solenoid valve 86*b* is made OFF, the hydraulic pressure is supplied to the third-speed hydraulic clutch C3 and accordingly, the counter third-speed gear 72 and countershaft 56 are interconnected so that the third speed is established.

Thus, one of the gear positions of the transmission 46 is selected (i.e., transmission control is conducted) by controlling ON/OFF of the first and second switching valves 84*a*, 84*b*.

Note that the operating oil (lubricating oil) from the hydraulic pump 60 is also supplied to the lubricated portions (e.g., the shafts 54, 56, 58, etc.) of the transmission 46 through the oil passage 80*b*, an oil passage 80*j*, a regulator valve 88 and a relief valve 90. Also, the first and second switching valves 84*a*, 84*b* and the first and second solenoid valves 86*a*, 86*b* are connected with an oil passage 80*k* adapted to relieve pressure.

The explanation on FIG. 2 is resumed. The shift mechanism 52 comprises a second connecting shaft 52*a* that is connected to the first connecting shaft 58 of the transmission mechanism 50 and installed parallel to the vertical axis to be rotatably supported, a forward bevel gear 52*b* and reverse bevel gear 52*c* that are connected to the second connecting shaft 52*a* to be rotated, a clutch 52*d* that can engage the propeller shaft 44 with either one of the forward bevel gear 52*b* and reverse bevel gear 52*c*, and other components.

The interior of the engine cover 32 is disposed with an electric shift motor (actuator) 92 that drives the shift mechanism 52. The output shaft of the shift motor 92 can be connected via a speed reduction gear mechanism 94 with the upper end of a shift rod 52*e* of the shift mechanism 52. When the shift motor 92 is operated, its output appropriately displaces the shift rod 52*e* and a shift slider 52*f* to move the clutch 52*d* to change the shift position among forward, reverse and neutral positions.

When the shift position is the forward or reverse position, the rotational output of the first connecting shaft 58 is transmitted via the shift mechanism 52 to the propeller shaft 44 to rotate the propeller 42 to generate the thrust in one of the directions making the boat 1 move forward or backward. The outboard motor 10 is equipped with a power source (not shown) such as a battery or the like attached to the engine 30 to supply operating power to the motors 22, 40, 92, etc.

As shown in FIG. 3, a throttle opening sensor 96 is installed near the throttle valve 38 and produces an output or signal indicative of opening of the throttle valve 38, i.e., throttle opening TH. A manifold absolute pressure sensor 98 is installed downstream of the throttle valve 38 in the air intake pipe 34 to produce an output or signal proportional to manifold absolute pressure (engine load) Pb.

A neutral switch 100 is installed near the shift rod 52*e* and produces an ON signal when the shift position of the transmission 46 is neutral and an OFF signal when it is forward or reverse. A crank angle sensor 102 is installed near the crankshaft of the engine 30 and produces a pulse signal at every predetermined crank angle.

The outputs of the foregoing sensor and switch are sent to an Electronic Control Unit (ECU) 110 disposed in the outboard motor 10. The ECU 110 comprises a microcomputer having a CPU, ROM, RAM and other devices and is installed in the engine cover 32 of the outboard motor 10. Among the sensor outputs, the ECU 110 counts the output pulses of the crank angle sensor 102 to detect or calculate the engine speed NE.

As shown in FIG. 1, a steering wheel 114 is installed near a cockpit (the operator's seat) 112 of the hull 12 to be manipulated by the operator (not shown). A steering angle sensor 116 attached on a shaft (not shown) of the steering wheel 114 produces an output or signal corresponding to the steering angle applied or inputted by the operator through the steering wheel 114.

A remote control box 120 provided near the cockpit 112 is equipped with a shift/throttle lever 122 installed to be manipulated by the operator. The lever 122 can be moved or swung in the front-back direction from the initial position and is used by the operator to input a forward/reverse change command and an engine speed regulation command A lever position sensor 124 is installed in the remote control box 120 and produces an output or signal corresponding to a position of the lever 122.

Figure 5:
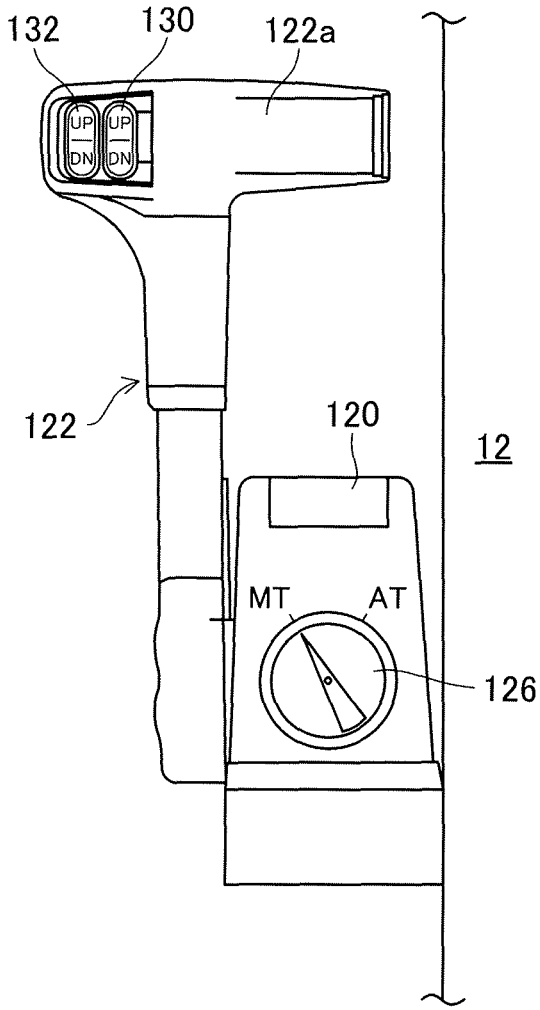
FIG. 5 is an enlarged side view of a remote control box and shift/throttle lever shown in FIG. 1 when viewed from the rear of the boat.

FIG. 5 is an enlarged side view of the remote control box 120 and lever 122 shown in FIG. 1 when viewed from the rear of the boat 1.

As shown in FIG. 5, a change switch 126 is installed in the remote control box 120 to be manipulated by the operator. The change switch 126 is manipulated to select one of a manual speed change mode ("MT" in FIG. 5) and automatic speed change mode ("AT") and produces an output or signal indicative of a selected mode. When the manual speed change mode is selected, transmission control of the transmission 46 is conducted in response to a speed change command inputted by the operator (explained later) and when the automatic speed change mode is selected, the transmission control is conducted based on the engine speed NE, lever 122 position, etc.

The lever 122 is equipped with a grip 122*a* to be gripped or held by the operator and the grip 122*a* is provided with a power tilt-trim switch (hereinafter called the "trim switch") 130 and shift switch (speed change command outputter) 132. The switches 130, 132 are installed to be manipulated by the operator.

The trim switch 130 comprises pushing type switches including an up switch ("UP" in FIG. 5) and a down switch ("DN"). When the up switch is pressed by the operator, the trim switch 130 produces an output or signal indicative of a tilt-up/trim-up command, while when the down switch is pressed, producing an output or signal indicative of a tilt-down/trim-down command.

Similarly, the shift switch 132 comprises pushing type switches including an up switch ("UP" in FIG. 5) and a down switch ("DN") and produces an output or signal indicative of a shift-up command (speed change command) when the up switch is pressed by the operator, while producing that indicative of a shift-down command (speed change command) when the down switch is pressed. Thus the switch 132 outputs the speed change command in response to the manipulation by the operator. The outputs of the sensors 116, 124 and switches 126, 130, 132 are also sent to the ECU 110.

Based on the inputted outputs, the ECU 110 controls the operation of the motors 22, 40, 92 and trim unit 24, while performing the transmission control of the transmission 46. Thus, the outboard motor control apparatus according to the first embodiment is a Drive-By-Wire type apparatus whose operation system (steering wheel 114, lever 122) has no mechanical connection with the outboard motor 10.

Figure 6:
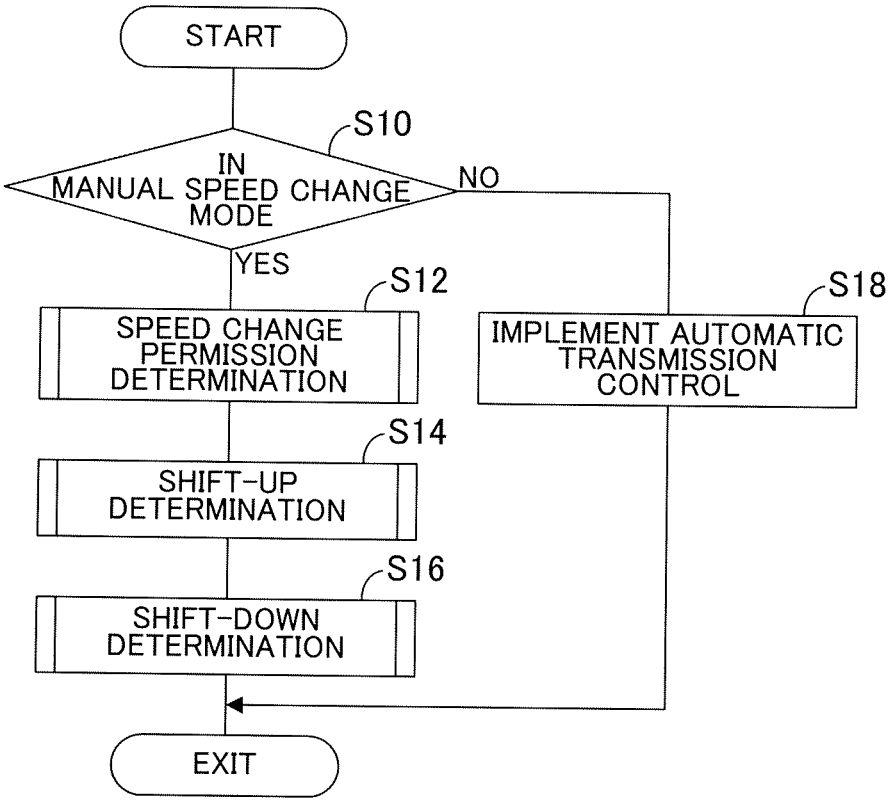
FIG. 6 is a flowchart showing transmission control operation by an electronic control unit shown in FIG. 1.

FIG. 6 is a flowchart showing the transmission control operation by the ECU 110. The illustrated program is executed by the ECU 110 at predetermined intervals, e.g., 100 milliseconds. Note that, although the transmission control between the first and second speeds is exemplified in the following for ease of understanding, the explanation is applicable to the transmission control between the second and third speeds or first and third speeds.

As shown in FIG. 6, the program begins at S10, in which based on the output of the change switch 126, it is determined whether the manual speed change mode is selected by the operator. When the result in S10 is affirmative, the program proceeds to S12, in which it is determined whether the gear position (speed) should be changed in response to the speed change command outputted from the shift switch 132.

Figure 7:
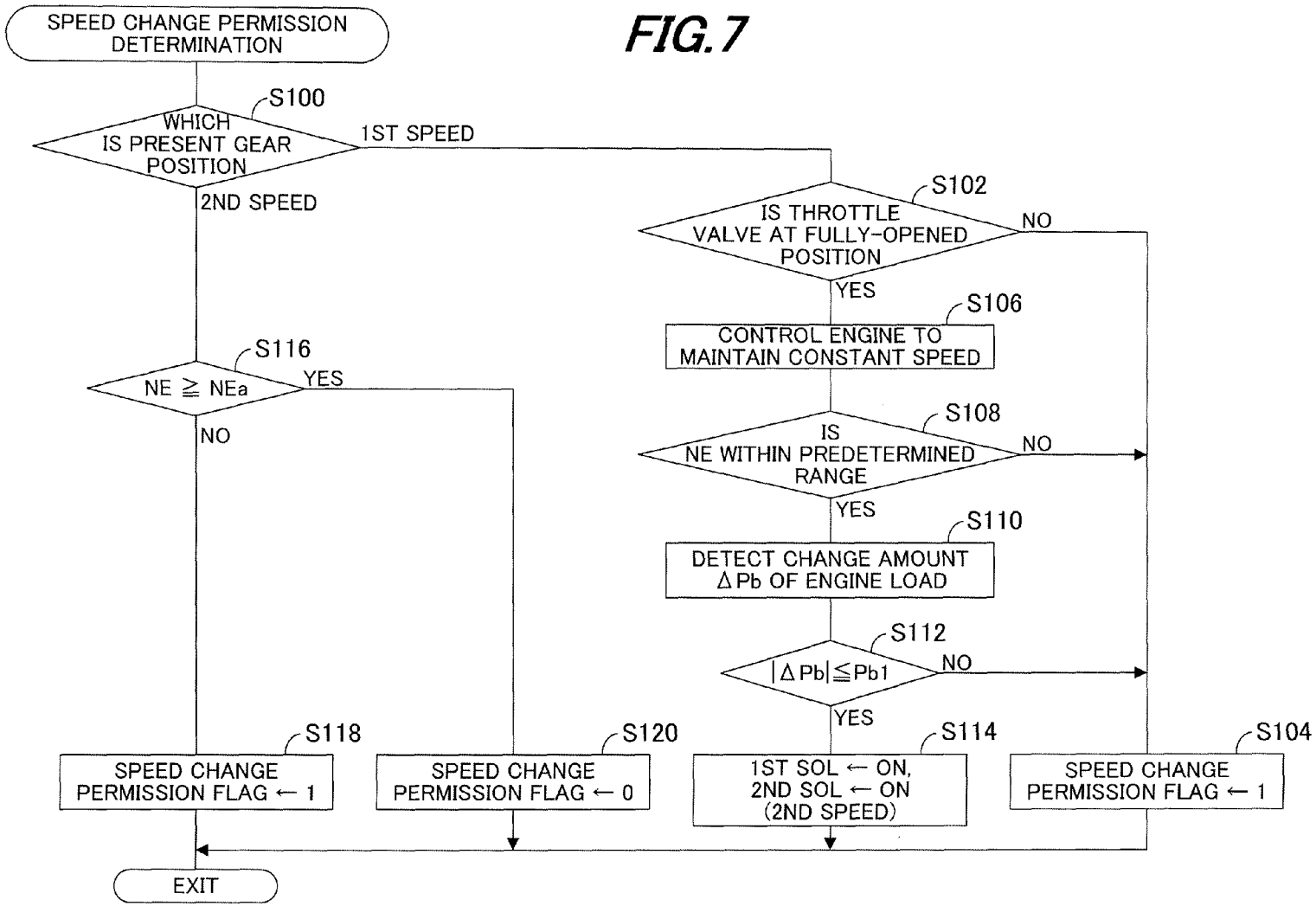
FIG. 7 is a subroutine flowchart showing the operation of speed change permission determination in the FIG. 6 flowchart.

FIG. 7 is a subroutine flowchart showing the operation of the speed change permission determination. First, in S100, the present gear position (speed) of the transmission 46 is determined. When the transmission 46 is determined to be in the first speed, the program proceeds to S102, in which based on the output of the throttle opening sensor 96, it is determined whether the throttle valve 38 is at the fully-opened position or thereabout, i.e., whether the throttle opening TH is substantially 90 degrees.

When the result in S102 is negative, it means that even when the transmission 46 is changed from the first speed to the second speed in response to the speed change command, the load on the transmission gears (input primary gear 64, counter primary gear 66, etc.) does not become excessive. Therefore, the program proceeds to S104, in which the bit of a manual speed change permission flag (hereinafter called the "speed change permission flag") is set to 1. The bit of this flag is set to 1 when the speed change to be conducted in response to the speed change command outputted from the shift switch 132 is permitted and reset to 0 when it is not permitted, i.e., is prohibited.

When the result in S102 is affirmative, the program proceeds to S106, in which the engine 30 is controlled to maintain a constant engine speed, i.e., the throttle opening TH, fuel injection amount and the like are controlled so as to maintain the engine speed NE at a preset speed. The preset speed is set lower than a value of overrrevving of the engine 30, e.g., set to 6000 rpm. As a result, it becomes possible to prevent overrevving of the engine 30.

Next the program proceeds to S108, in which it is determined whether the engine speed NE is within a predetermined range. The predetermined range is set at or about the preset speed, e.g., set to a range between 5750 rpm and 6240 rpm. Specifically, the determination of S108 is made for checking as to whether the engine 30 has entered a high-speed range, i.e., a range in which, in the case where the gear position is in the first speed, the excessive load may act on the transmission gear of the transmission 46.

When the result in S108 is negative, the program proceeds to the aforementioned S104, while when the result is affirmative, proceeding to S110, in which based on the output of the manifold absolute pressure sensor 98, a change amount (variation) ΔPb of the manifold absolute pressure Pb (i.e., a change amount of the engine load) per unit time (e.g., 500 milliseconds) is detected or calculated.

Next the program proceeds to S112, in which it is determined whether the engine 30 is under a predetermined operating condition, i.e., whether an absolute value of the detected change amount ΔPb of the manifold absolute pressure Pb is equal to or less than a predetermined value Pb1. The predetermined operating condition represents a condition where the engine 30 is in the high-speed range and the excessive load acts on the transmission gear of the transmission 46 so that the gear position should be changed from the first speed to the second speed.

Further detailed explanation will be made on S112. When the transmission 46 is in the first speed and the engine 30 is continuously in the high-speed range for a long time, it means that the excessive load acts on the transmission 46 and hence, it is preferable to forcibly change the gear position to the second speed. However, in the case where the boat 1 goes over a relatively big wave during cruising, it is rather preferable to maintain the gear position of the transmission 46 in the first speed so that the output torque of the engine 30 is amplified through the transmission 46 (precisely, the transmission mechanism 50) and transmitted to the propeller 42, because it makes possible to easily keep the balanced attitude of the hull 12.

Therefore, this embodiment is configured to detect or estimate whether the boat 1 is in a condition where it is about to go over a wave based on the variation in the engine load and when the boat 1 is detected to be in such the condition, make the boat 1 to continue to cruise in the first speed as selected by the operator.

To be more specific, in S112, the absolute value of the change amount ΔPb of the manifold absolute pressure is compared to the predetermined value Pb1 and when the absolute value is greater than the predetermined value Pb1, it is determined that the boat 1 is about to go over a wave. In other words, despite the fact that the throttle valve 38 is at the fully-opened position or thereabout and the engine speed NE hardly varies within the predetermined range, when the manifold absolute pressure (engine load) Pb is greatly changed, it is estimated that the change is caused by a wave. The predetermined value Pb1 is set as a criterion for determining whether the engine load is changed due to the influence of a wave, e.g., set to 10 kPa.

When the result in S112 is negative, i.e., when the change in the engine load is relatively large, the program proceeds to S104, in which the program is terminated with the first speed being maintained, and when the result is affirmative, the program proceeds to S114, in which the operation of the transmission 46 is controlled, more exactly, the first and second solenoid valves 86*a*, 86*b* (indicated by "1ST SOL," "2ND SOL" in the drawing) are both made ON to change the gear position (shift up the gear) from the first speed to the second speed. As a result, the engine speed NE is decreased and the transmission gear can avoid the excessive load accordingly.

When the transmission 46 is determined to be in the second speed in S100, the program proceeds to S116, in which it is determined whether the engine speed NE is equal to or greater than a predetermined speed NEa. The predetermined speed NEa is set to a relatively high value (e.g., 4500 rpm) as a criterion for determining that, when the gear position is changed from the second speed to the first speed at the time the engine 30 is operated at speed of the criterion value (i.e., 4500 rpm in this example), the excessive load likely acts on the transmission gears of the transmission 46, while the engine speed NE is increased and may result in overrevving of the engine 30.

When the result in S116 is negative, it means that even when the transmission 46 is changed from the second speed to the first speed in response to the speed change command, the load on the transmission gears does not become excessive. Therefore, the program proceeds to S118, in which the bit of the speed change permission flag is set to 1. When the result in S116 is affirmative, the program proceeds to S120, in which the bit of the speed change permission flag is reset to 0.

Returning to the explanation on FIG. 6, the program proceeds to S14, in which it is determined whether the shift-up operation is conducted in response to the shift-up command outputted from the shift switch 132.

Figure 8:
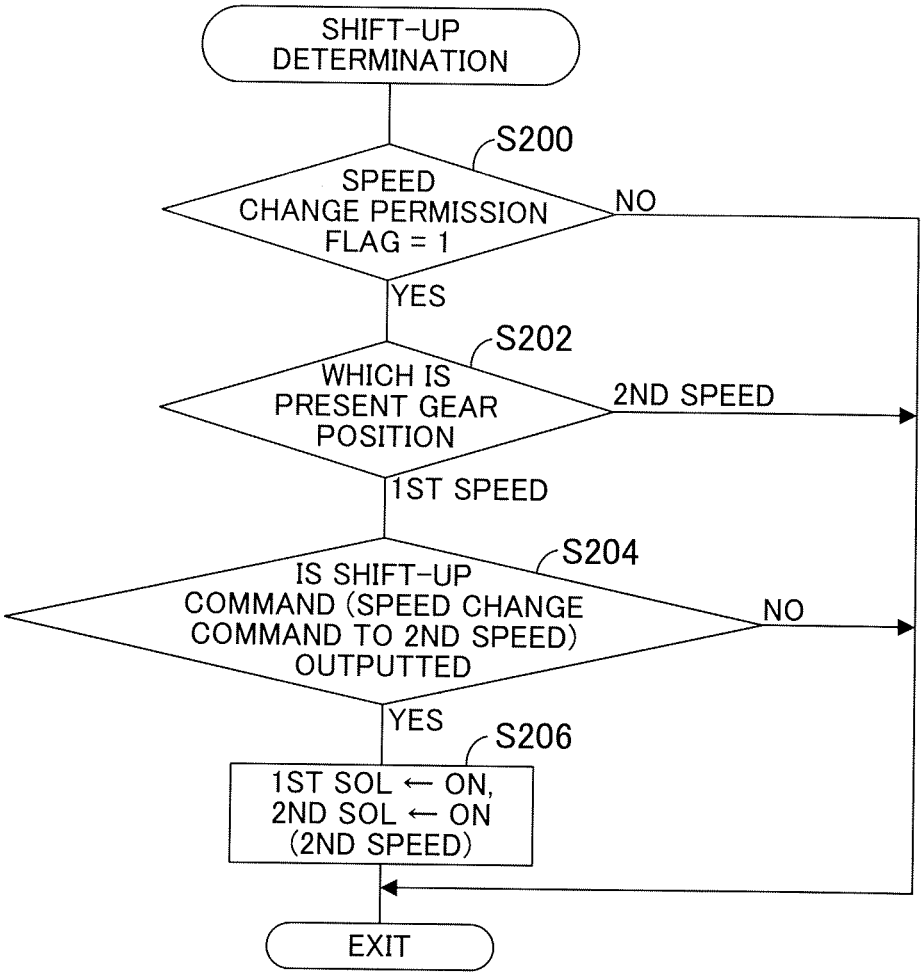
FIG. 8 is a subroutine flowchart showing the operation of shift-up determination in the FIG. 6 flowchart.

FIG. 8 is a subroutine flowchart showing the operation of the shift-up determination. First, in S200, it is determined whether the bit of the speed change permission flag is 1. When the result in S200 is affirmative, the program proceeds to S202, in which the present gear position of the transmission 46 is determined. When the transmission 46 is determined to be in the second speed, the remaining steps are skipped, while when determined to be in the first speed, the program proceeds to S204.

In S204, it is determined whether the shift-up command, precisely the speed change command to change the gear position from the first speed to the second speed is outputted from the shift switch 132. When the result in S204 is negative, the program is immediately terminated and when the result is affirmative, proceeds to S206, in which the first and second solenoid valves 86*a*, 86*b* are both made ON to change the gear position (shift up the gear) from the first speed to the second speed.

When the result in S200 is negative, the steps of S202 to S206 are skipped. In other words, in the case where the bit of the speed change permission flag is 0, even when the shift-up command is outputted from the shift switch 132, the transmission 46 is not shifted up (shift-up operation is prohibited).

Returning to the explanation on FIG. 6, the program proceeds to S16, in which it is determined whether the shift-down operation is conducted in response to the shift-down command outputted from the shift switch 132.

Figure 9:
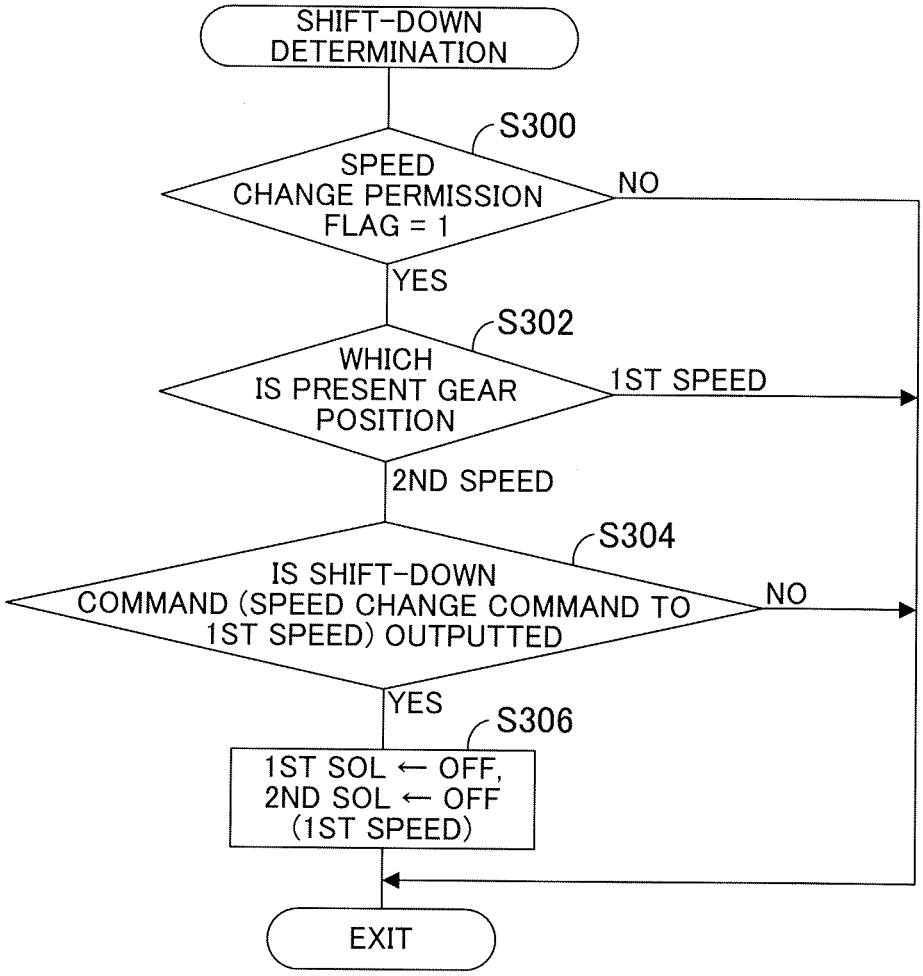
FIG. 9 is a subroutine flowchart showing the operation of shift-down determination in the FIG. 6 flowchart.

FIG. 9 is a subroutine flowchart showing the operation of the shift-down determination. First, in S300, it is determined whether the bit of the speed change permission flag is 1. When the result in S300 is affirmative, the program proceeds to S302, in which the present gear position of the transmission 46 is determined. When the transmission 46 is determined to be in the first speed in S302, the remaining steps are skipped, while when determined to be in the second speed, the program proceeds to S304, in which it is determined whether the shift-down command, precisely the speed change command to change the gear position from the second speed to the first speed is outputted from the shift switch 132.

When the result in S304 is negative, the program is immediately terminated and when the result is affirmative, proceeds to S306, in which the first and second solenoid valves 86*a*, 86*b* are both made OFF to change the gear position (shift down the gear) from the second speed to the first speed.

When the result in S300 is negative, the steps of S302 to S306 are skipped. In other words, in the case where the bit of the speed change permission flag is 0, even when the shift-down command is outputted from the shift switch 132, the transmission 46 is not shifted down (shift-down operation is prohibited).

In the FIG. 6 flowchart, when the result in S10 is negative, i.e., when the automatic speed change mode is selected, the program proceeds to S18, in which automatic transmission control is implemented. The automatic transmission control is configured to determine the gear position (speed) to be established by retrieving mapped values stored in the ROM using the engine speed NE, throttle opening TH, lever 122 position, etc., and control the operation of the transmission 46 (i.e., transmission mechanism 50) so as to establish the determined gear position (speed). This will not be explained in detail here, since it is not directly related to the gist of this invention.

Figure 10:
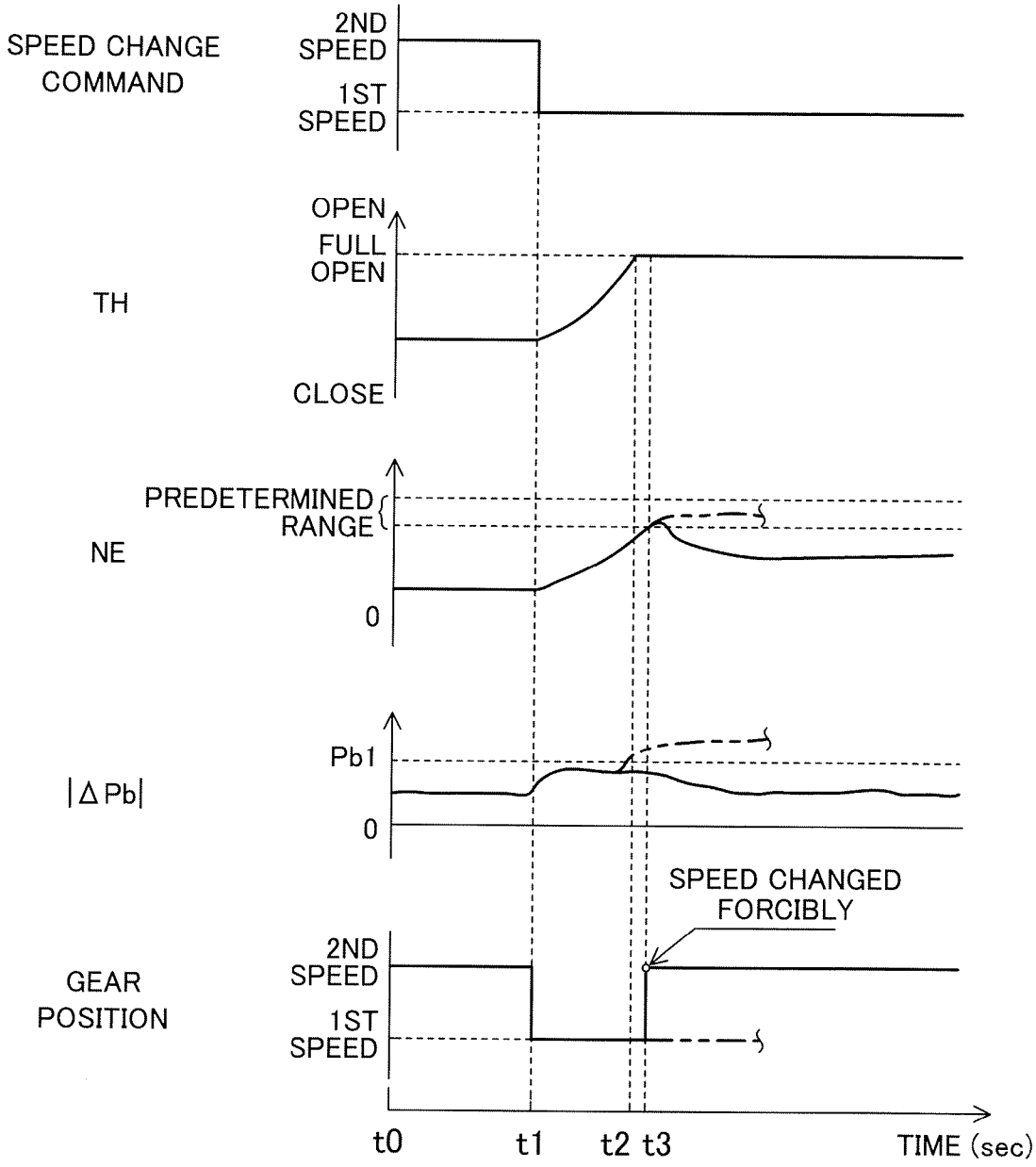
FIG. 10 is a time chart for explaining the operation of the flowcharts of FIGS. 6 to 9.

FIG. 10 is a time chart for explaining part of the above operation, specifically the transmission control in the manual speed change mode. In FIG. 10, there are indicated, in the order from the top, the speed change command of the shift switch 132, the throttle opening TH, the engine speed NE, the change amount ΔPb of the manifold absolute pressure Pb and the present gear position of the transmission 46.

From the time t0 to t1, the transmission 46 is in the second speed and the throttle opening TH is not at the fully-opened position or thereabout. At the time t1, when the speed change command to change the gear position to the first speed is outputted from the shift switch 132 (S304), the transmission 46 is changed from the second speed to the first speed in response thereto (S306).

After that, under the condition where the speed change command to the first speed is outputted from the shift switch 132, the throttle valve 38 is opened to the fully-opened position or thereabout upon the manipulation of the lever 122 (time t2; S102) and at the time t3, the engine speed NE reaches a value within the predetermined range so that the engine 30 enters the high-speed range (S108).

At the time t3, when the change amount ΔPb of the manifold absolute pressure (engine load) Pb is determined to be equal to or less than the predetermined value Pb1 (the engine 30 is under the predetermined operating condition) (S112), the transmission 46 is forcibly changed from the first speed to the second speed (S114). As a result, the engine speed NE is decreased.

In contrast, at the time t3, when the change amount ΔPb is determined to be greater than the predetermined value Pb1, i.e., when the engine 30 is not under the predetermined operating condition and it is estimated that the boat 1 is about to go over a wave, as indicated by imaginary lines in FIG. 10, the gear position is maintained in the first speed (S112, S104).

As mentioned in the foregoing, the first embodiment is configured such that, when it is determined that the throttle valve 38 is at the fully-opened position or thereabout and the engine 30 is under the predetermined operating condition at the time the speed change command to the first speed is outputted from the shift switch 132, the gear position is changed from the first speed to the second speed, i.e., the gear position is forcibly changed from the first speed to the second speed to decrease the engine speed NE. Consequently, it becomes possible to, for example, set the predetermined operating condition to a condition where the engine 30 is in the high-speed range and the excessive load acts on the transmission gear of the transmission 46 so that the gear position should be changed from the first speed to the second speed. Therefore, since the gear position can be forcibly changed from the first speed to the second speed when the engine 30 is in such the operating condition, it becomes possible to prevent the engine 30 from being operated at high speed continuously for a long time, thereby mitigating the load on the transmission gear and improving durability of the transmission.

Further, it is configured to detect the change amount ΔPb of the engine load (manifold absolute pressure) and determine that the engine 30 is under the predetermined operating condition when the change amount ΔPb is equal to or less than the predetermined value Pb1. With this, it becomes possible to accurately determine that the engine 30 is continuously operated at high speed so that the gear position should be changed from the first speed to the second speed. Since the gear position can be changed from the first speed to the second speed in such the operating condition of the engine 30, the engine speed NE is decreased, thereby reliably mitigating the load on the transmission gear and still further improving durability of the transmission.

An outboard motor control apparatus according to a second embodiment of the invention will be explained.

Explaining with focus on the points of difference from the first embodiment, in the second embodiment, the Drive-By-Wire (DBW) system to open/close the throttle valve 38 using the throttle motor 40 is not employed but the throttle valve 38 and the lever 122 are mechanically interconnected by a wire (push-pull cable). In other words, the lever 122 is manipulated to directly control the throttle valve 38 to open and close, thereby regulating the engine speed NE. Further, the second embodiment is configured to determine whether the engine 30 is under the predetermined operating condition based on a change amount ΔNE of the engine speed NE in place of the change amount ΔPb of the engine load.

Figure 11:
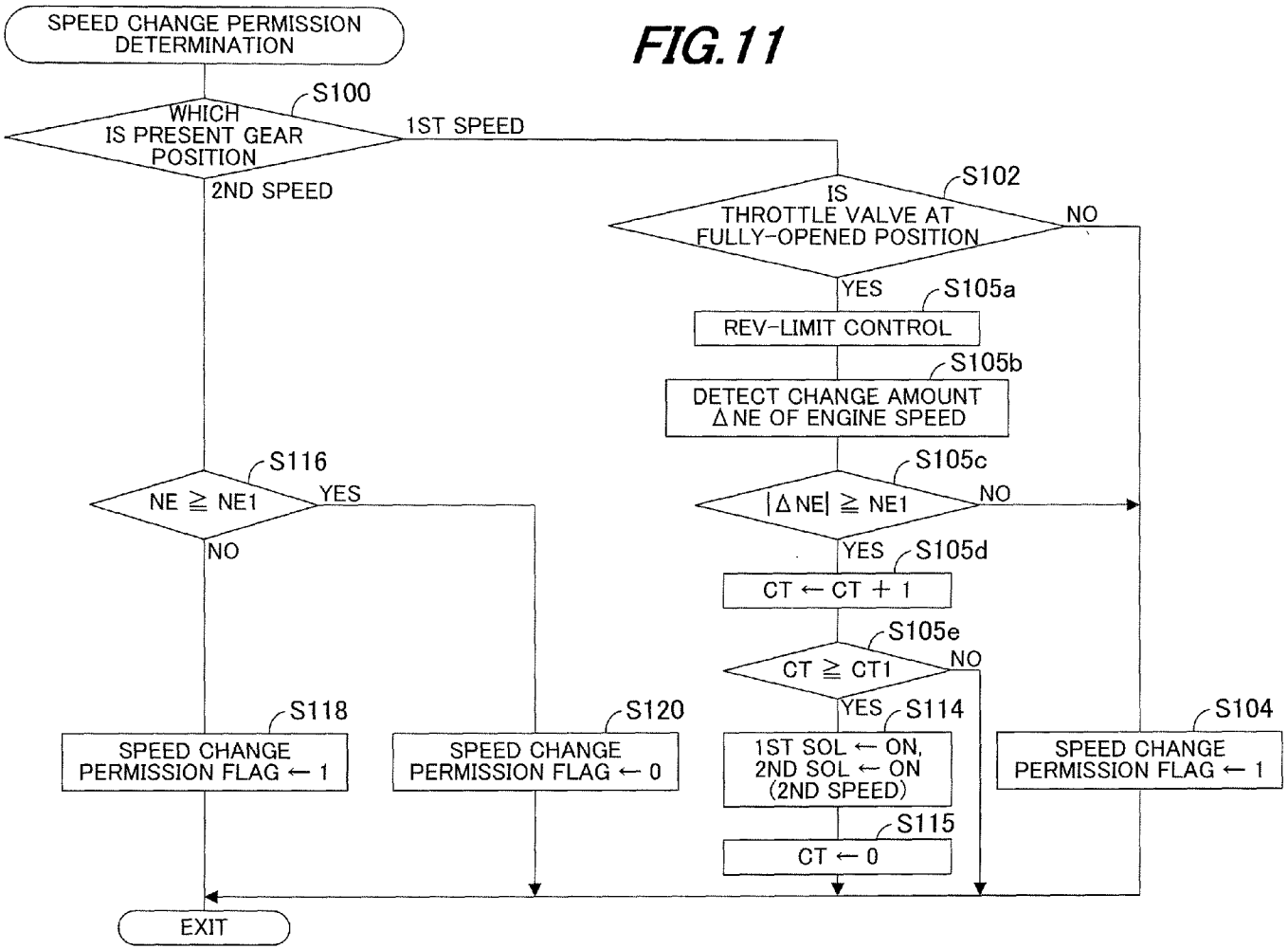
FIG. 11 is a subroutine flowchart similar to FIG. 7, but showing the operation of speed change permission determination in transmission control executed by an electronic control unit of an outboard motor control apparatus according to a second embodiment of the invention.

FIG. 11 is a subroutine flowchart similar to FIG. 7, but showing the operation of speed change permission determination by the ECU 110 according to the second embodiment. Note that steps of the same process as in the first embodiment are given with the same step numbers and their explanation will be omitted.

The process of S100 to S104 is conducted similarly to those in the first embodiment. When the result in S102 is affirmative, the program proceeds to S105*a*, in which rev-limit control that prevents overrevving of the engine 30 is conducted.

Specifically, since the apparatus according to this embodiment does not employ the DBW system of the throttle valve 38, the engine speed control is required for preventing overrevving of the engine 30 when the throttle valve 38 is at the fully-opened position or thereabout. More exactly, in the rev-limit control, when the engine speed NE exceeds the maximum engine speed (rev limit; e.g., 6000 rpm), the fuel cut-off, ignition cut-off or the like is conducted to decrease the engine speed NE to a value at or below the maximum engine speed.

Then the program proceeds to S105*b*, in which the change amount (variation) ΔNE of the engine speed NE per unit time (e.g., 500 milliseconds) is detected or calculated and to S105*c*, in which it is determined whether the engine 30 is under the predetermined operating condition, i.e., whether an absolute value of the change amount DNE is equal to or greater than a prescribed value NE1.

Further detailed explanation will be made on S105*c*. As explained above, when the transmission 46 is in the first speed and the engine 30 is continuously in the high-speed range for a long time, it means that the excessive load acts on the transmission 46 and hence, it is preferable to forcibly change the gear position to the second speed. In addition, when the throttle valve 38 is at the fully-opened position or thereabout and the engine 30 is operated at speed within the high-speed range, the fuel cut-off, etc., of the rev-limit control may cause relatively great change in the engine speed NE (more precisely, the engine speed NE may be greatly decreased temporarily).

Therefore, in the process of S105*c*, when the engine speed NE is greatly changed, it is determined that the engine 30 is continuously in the high-speed range for a long time and the gear position is changed to the second speed in another program (explained later). The prescribed value NE1 is set as a criterion (e.g., 500 rpm) for determining whether the engine speed NE is changed due to the fuel cut-off, etc., of the rev-limit control.

When the result in S105*c* is negative, the program proceeds to S104, while when the result is affirmative, proceeding to S105*d*, in which a value of a counter CT (initial value 0) for counting the number of times that the change amount ΔNE is determined to be equal to or greater than the prescribed value NE1, is incremented by 1. Then the program proceeds to S105*e*, in which it is determined whether the value of the counter CT is equal to or greater than a predetermined number CT1 (e.g., 3).

When the process of S105*e* is first conducted, since the counter CT value is 1, the result is negative and the program is immediately terminated. When the result in S105*e* is affirmative, the program proceeds to S114, in which the first and second solenoid valves 86*a*, 86*b* are both made ON to change the gear position (shift up the gear) from the first speed to the second speed. As a result, the engine speed NE is decreased and the transmission gear can avoid the excessive load accordingly. Next the program proceeds to S115, in which the counter CT value is reset to 0.

Figure 12:
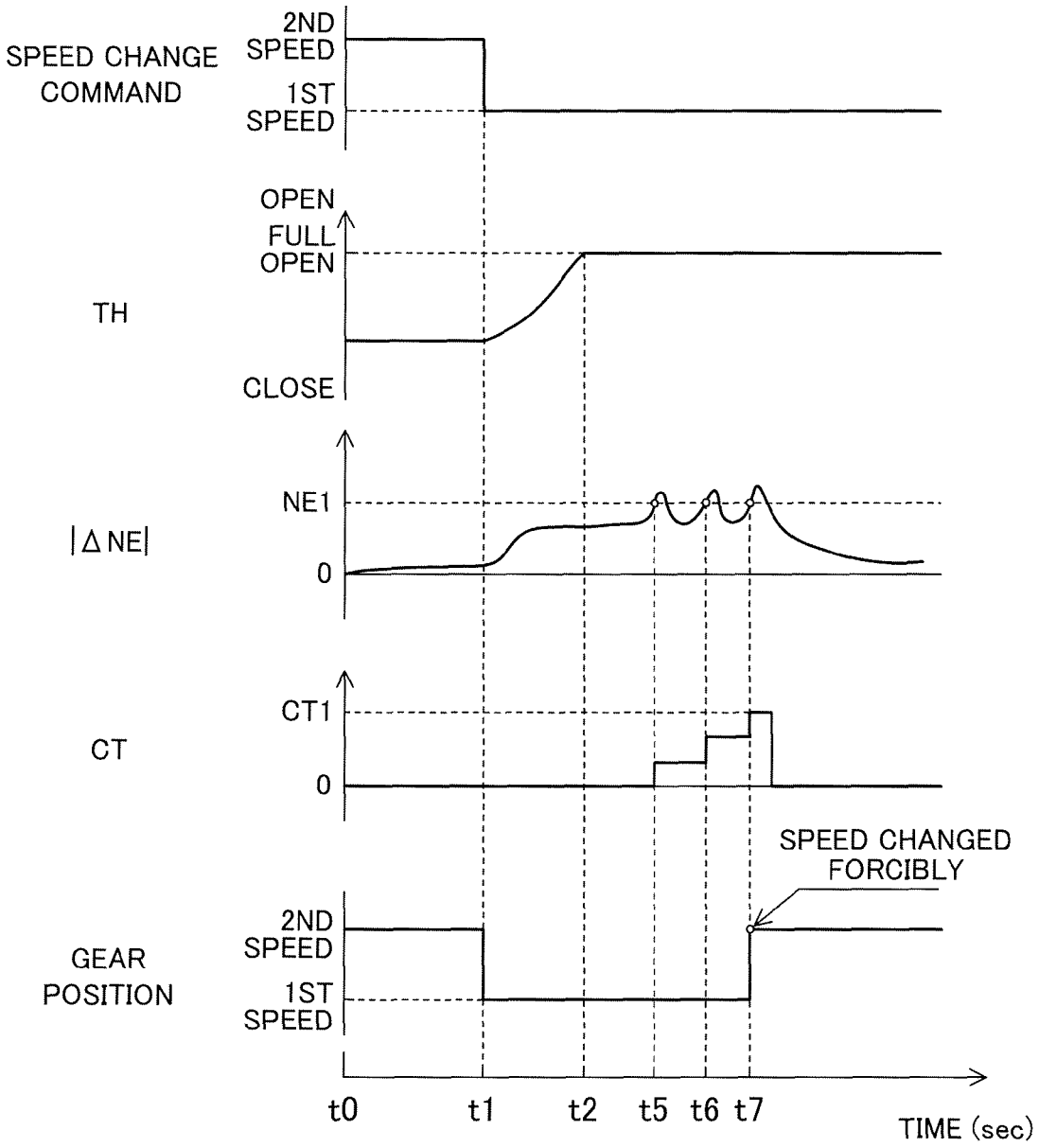
FIG. 12 is a time chart similar to FIG. 10, but for explaining the operation of the FIG. 11 flowchart, etc.

FIG. 12 is a time chart similar to FIG. 10, but for explaining part of the foregoing operation, i.e., the transmission control in the manual speed change mode. In FIG. 12, there are indicated, in the order from the top, the speed change command of the shift switch 132, the throttle opening TH, the change amount ΔNE of the engine speed NE, the value of the counter CT and the present gear position of the transmission 46.

The explanation on the time t0 to t2 is omitted here, as it is the same as in the first embodiment. After the throttle valve 38 is opened to the fully-opened position or thereabout at the time t2 so that the engine 30 enters the high-speed range, when it is determined that the change amount ΔNE of the engine speed NE is equal to or greater than the prescribed value NE1 (the engine 30 is under the predetermined operating condition) (S105*c*) as indicated at the time t5, the counter CT value is incremented by 1 (S105*d*).

When, at the time t6, the change amount ΔNE is again determined to be equal to or greater than the prescribed value NE1, the counter CT value is further incremented by 1. When, at the time t7, the counter CT value has reached the predetermined number CT1 (S105*e*), the transmission 46 is forcibly changed from the first speed to the second speed (S114). As a result, the engine speed NE is decreased.

Thus, the second embodiment is configured to detect the change amount ΔNE of the engine speed NE and determine that the engine 30 is under the predetermined operating condition when the change amount ΔNE is equal to or greater than the prescribed value NE1. With this, it becomes possible to accurately determine that the engine 30 is continuously operated at high speed so that the gear position should be changed from the first speed to the second speed. Since the gear position can be changed from the first speed to the second speed under such the operating condition of the engine 30, the engine speed NE is decreased, thereby reliably mitigating the load on the transmission gear and still further improving durability of the transmission.

The remaining configuration is the same as that in the first embodiment.

As stated above, the first and second embodiments are configured to have an apparatus and a method for controlling operation of an outboard motor 10 adapted to be mounted on a stern 12*a* of a boat 1 and having an internal combustion engine 30 to power a propeller 42 through a drive shaft (input shaft) 54 and a propeller shaft 44, and a transmission 46 that is installed at a location between the drive shaft 54 and the propeller shaft 44, the transmission 46 being selectively changeable in gear position to establish speeds including at least a first gear speed and a second gear speed and transmitting power of the engine 30 to the propeller 42 with a gear ratio determined by established speed, comprising: a shift switch 132 which outputs a speed change command (shift-up/down command) upon manipulation by an operator; and an electronic control unit 110, which controls operation of the transmission 46 to change the gear position to the first-speed gear or the second speed in response to the outputted speed change command (ECU 110, S14, S16, S204, S206, S304, S306, and which determine whether a throttle valve 38 of the engine 30 is at a fully-opened position or thereabout when the speed change command to the first gear speed is outputted (ECU 110, S12, S102), and which determines whether the engine 30 is under a predetermined operating condition when the throttle valve 38 is determined to be at the fully-opened position or thereabout (ECU 110, S12, S112, S105*c*)), and wherein the transmission changes the gear position from the first speed gear to the second speed gear when the engine 30 is determined to be under the predetermined operating condition (S12, S114).

The apparatus, includes a manifold absolute pressure sensor (98, S12, S110) to detect a change amount ΔPb of load (manifold absolute pressure Pb) of the engine 30, and to determine that the engine 30 is under the predetermined operating condition when the detected change amount ΔPb of the engine load is equal to or less than a predetermined value Pb1 (S12, S112).

In the apparatus, the predetermined value Pb1 is set as a criterion for determining whether the load (Pb) of the engine 30 is changed due to influence of a wave (e.g., 10 kPa).

The apparatus includes: a crank angle sensor (102, S12, S105*b*) to detect a change amount ΔNE of a speed NE of the engine 30, and to determine that the engine 30 is under the predetermined operating condition when the detected change amount ΔNE of the engine speed NE is equal to or greater than a prescribed value NE1 (S12, S105*c*).

In the apparatus, the prescribed value NE1 is set as a criterion for determining whether the engine speed NE is changed due to fuel cut-off of rev-limit control (e.g., 500 rpm).

It should be noted that, although the outboard motor is exemplified above, this invention can be applied to an inboard/outboard motor equipped with a transmission.

It should also be noted that, although the predetermined value Pb1, predetermined speed NE1, prescribed value NE1, displacement of the engine 30 and other values are indicated with specific values in the foregoing, they are only examples and not limited thereto.

Japanese Patent Application No. 2010-123290, filed on May 28, 2010 is incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling operation of an outboard motor having an internal combustion engine to power a propeller through a drive shaft and a propeller shaft, and a transmission that is installed at a location between the drive shaft and the propeller shaft, the transmission being selectively changeable in gear position to establish speeds of at least a first gear speed and a second gear speed and transmitting power of the engine to the propeller with a gear ratio determined by established speed, comprising:

a shift switch, that is located on a throttle control lever and outputs a speed change command upon manipulation by an operator; and an electronic control unit which controls the transmission to change the gear position to the first speed gear or the second speed gear in response to the outputted speed change command, and a throttle opening sensor which indicates whether a throttle valve of the engine is at a fully-opened position or thereabout when the speed change command to the first gear speed is outputted, and sends an output to the electronic control unit, and a sensor which determines whether the engine is under a predetermined operating condition when the throttle valve is determined to be at the fully-opened position or thereabout and sends an output to the electronic control unit, wherein the transmission changes the gear position from the first speed gear to the second speed gear when the engine is determined to be under the predetermined operating condition.

2. The apparatus according to claim 1, wherein a manifold absolute pressure sensor detects a change amount of load of the engine and determines that the engine is under the predetermined operating condition when the detected change amount of the engine load is equal to or less than a predetermined value.

3. The apparatus according to claim 2, wherein the predetermined value, is set as a criterion for determining whether the load of the engine is changed due to influence of a wave.

4. The apparatus according to claim 1, wherein the operating condition is determined by a crank angle sensor which detects a change amount of a speed of the engine, and determines that the engine is under the predetermined operating condition when the detected change amount of the engine speed is equal to or greater than a prescribed value.

5. The apparatus according to claim 4, wherein the prescribed value is set as a criterion for determining whether the engine speed is changed due to fuel cut-off of rev-limit control.

6. A method for controlling operation of an outboard motor having an internal combustion engine to power a propeller through a drive shaft and a propeller shaft, and a transmission that is installed at a location between the drive shaft and the propeller shaft, the transmission being selectively changeable in gear position to establish at least a first speed gear and a second speed gear and transmitting power of the engine to the propeller with a gear ratio determined by the established gear position, comprising the steps of:

outputting a speed change command upon manipulation by an operator, of a shift switch located on a throttle control lever, to send an output to an electronic control unit;

wherein the electronic control unit controls the transmission to change the gear position to the first-speed gear or the second-speed gear in response to the outputted speed change command from the electronic control unit;

determining whether a throttle valve of the engine is at a fully-opened position or thereabout, when the speed change command to the first speed gear is outputted; and determining whether the engine is under a predetermined operating condition based on at least one of a change in engine speed and a change in engine load, when the throttle valve is determined to be at the fully-opened position or thereabout, and changing the gear position from the first-speed gear to the second-speed gear when the engine is determined to be under the predetermined operating condition.

7. The method according to claim 6, wherein the step of determining whether the engine is under the predetermined operating condition includes the step of:

detecting a change amount of load of the engine based on output from a manifold absolute pressure sensor, and determining that the engine is under the predetermined operating condition when the detected change amount of the engine load is equal to or less than a predetermined value.

8. The method according to claim 7, wherein the predetermined value is set as a criterion for determining whether the load of the engine is changed due to influence of a wave.

9. The method according to claim 6, wherein the step of determining whether the engine is under the predetermined operating condition includes the step of:

detecting a change amount of a speed of the engine based on output from a crank angle sensor, and determining that the engine is under the predetermined operating condition when the detected change amount of the engine speed is equal to or greater than a prescribed value.

10. The method according to claim 9 wherein a prescribed value is set as a criterion for determining whether the engine speed is changed due to fuel cut-off of rev-limit control.

11. The apparatus of claim 1 wherein the electronic control unit controls the transmission to change the gear position from the first-speed gear to the second-speed gear when the engine is determined to be under the predetermined operating condition.

12. An apparatus for controlling operation of an outboard motor having an internal combustion engine to power a propeller through a drive shaft and a propeller shaft, and a transmission that is installed at a location between the drive shaft and the propeller shaft, the transmission being selectively changeable in gear position to establish at least first speed gear and second speed gear and transmitting power of the engine to the propeller with a gear ratio determined by established speed, comprising:

a shift switch which outputs a speed change command upon manipulation by an operator; and an electronic control unit which controls operation of the transmission to change the gear position to the first-speed gear or the second-speed gear in response to the outputted speed change command; and a throttle opening sensor which determines if a throttle valve of the engine is at a fully-opened position or thereabout when the speed change command to the first-gear speed is outputted and sends an output to the electronic control unit; and a sensor selected from at least one of a crank angle sensor and a manifold absolute pressure sensor which determines if the engine is under a predetermined operating condition when the throttle valve is determined to be at the fully-opened position or thereabout, wherein the electronic control unit controls the transmission to changes the gear position from the first-speed gear to the second-speed gear when the engine is determined to be under the predetermined operating condition.

13. The method according to claim 6, wherein the step of determining whether the engine is under the predetermined operating condition includes the step of:

detecting a change amount of load of the engine, and determining that the engine is under the predetermined operating condition when the detected change amount of the engine load is equal to or less than a predetermined value, based on output of a manifold absolute pressure sensor.

* * * * *